US007475794B2

(12) United States Patent
Walther et al.

(10) Patent No.: US 7,475,794 B2
(45) Date of Patent: Jan. 13, 2009

(54) PRODUCT DISPENSER ACCESSORY FOR CHILDREN

(75) Inventors: John Dwayne Walther, Loveland, OH (US); Jeffrey James Stechschulte, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 44 days.

(21) Appl. No.: 11/189,248

(22) Filed: Jul. 26, 2005

(65) Prior Publication Data

US 2006/0027596 A1 Feb. 9, 2006

Related U.S. Application Data

(60) Provisional application No. 60/598,779, filed on Aug. 4, 2004.

(51) Int. Cl.
*B05B 11/00* (2006.01)

(52) U.S. Cl. ..... 222/78; 222/321.9; 446/475

(58) Field of Classification Search ..... 222/78, 222/321.9; 206/457; 446/475
See application file for complete search history.

(56) References Cited

U.S. PATENT DOCUMENTS

| | | | | |
|---|---|---|---|---|
| 3,388,835 | A * | 6/1968 | Naughten | 222/78 |
| 4,193,517 | A * | 3/1980 | Fetty et al. | 222/78 |
| 5,301,836 | A * | 4/1994 | Luu | 222/78 |
| 5,456,626 | A | 10/1995 | Ming-Kang et al. | |
| 5,887,754 | A * | 3/1999 | Wilkinson | 222/78 |
| 6,145,553 | A | 11/2000 | Sofy et al. | |
| 6,237,787 | B1 | 5/2001 | Gallo et al. | |
| D463,983 | S | 10/2002 | Wendt et al. | |
| 6,536,685 | B2 | 3/2003 | Bennett | |
| 2005/0194400 | A1 * | 9/2005 | Berube et al. | 222/78 |

FOREIGN PATENT DOCUMENTS

| | | | |
|---|---|---|---|
| DE | 198 40 748 | A1 | 3/2000 |
| JP | 08 282749 | A | 10/1996 |

OTHER PUBLICATIONS

Kid Care® "Scooby-Doo" Talking Liquid Hand Soap Dispenser, photograph of front and back views of the product and product packaging, discovered May 2004, 2 pages.
Konami, "Chatting Shampoo (Winnie the Poo)", product information and product picture, May 2004, 1 page.
Alex, "Toothpaste Pet—Frog", product information and product picture, Aug. 2004, 1 page.
PCT Search Report, mailed Sep. 1, 2006, 4 pages.

* cited by examiner

*Primary Examiner*—Frederick C. Nicolas
(74) *Attorney, Agent, or Firm*—Sarah Ann Dressel; Thibault Fayette

(57) ABSTRACT

An accessory is provided for a product dispenser having a container for holding a product. The container defines a center axis and has a normal dispensing position, and a dispensing mechanism is coupled to the container and has a discharge opening adapted to direct product toward a desired target area when the container is in the normal dispensing position. The accessory is a first stabilizing element coupled to at least one of the container and dispensing mechanism and adapted to maintain the container in the normal dispensing position, thereby to more reliably direct product toward the target area during use. The first stabilizing element incorporates at least one physical feature attractive to a child.

27 Claims, 3 Drawing Sheets

PRODUCT DISPENSER ACCESSORY FOR CHILDREN

CROSS REFERENCE TO RELATED APPLICATION

This application claims the benefit of U.S. Provisional Application 60/598,779 filed on Aug. 4, 2004.

FIELD OF THE INVENTION

The present disclosure generally relates to containers for dispensing products and, more particularly, to product dispensers particularly suited for use by children.

BACKGROUND OF THE INVENTION

Various types of product dispensers are generally known in the art. Such dispensers may hold liquid, solids, or a combination thereof. Increasingly, products are being specifically marketed for use by children. For example, liquid soap, shampoo, baby powder, oral hygiene products, and the like are marketed using packaging and advertising intended to draw the attention of a child. In many cases, the container and/or packaging provided with the product dispenser is modified to have a decorative external appearance. Previous containers have been provided with three-dimensional components to provide a shape to the container that resembles an object, such as an animal or cartoon character, which may generate enthusiasm for performing the hygiene task associated with the product that otherwise may not exist in the absence of the decorative dispenser appearance.

While these products have been designed to appeal to a child, in general they are not adapted for use by the child. The motor skills of a child are not as advanced as an adult, and therefore operations that seem common or routine to an adult can be more difficult for a child. When operating a pump-type liquid soap dispenser, for example, a child may have difficulty applying sufficient force in the appropriate direction to operate the pump, which may cause the dispenser to move, tip, or otherwise fail to discharge the product toward the intended target. Currently, while previous product dispensers may be successful in attracting a child's attention to influence a purchasing decision, the difficulties encountered during use of the product ultimately cause frustration and discourage the child from further use of the product.

DETAILED DESCRIPTION

Figure 1:
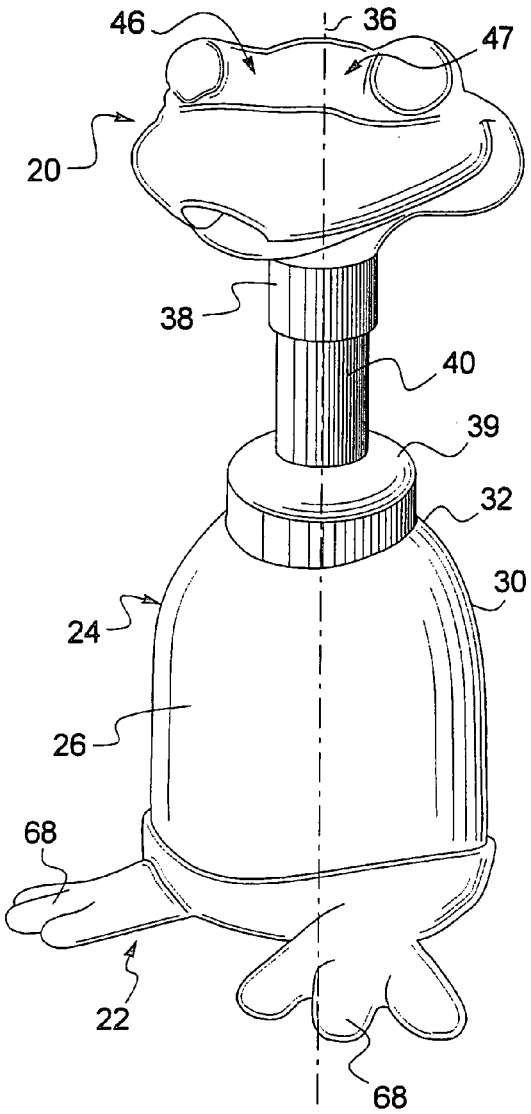
FIG. 1 is a perspective view of a product dispenser including grip and base accessories.
Figure 2:
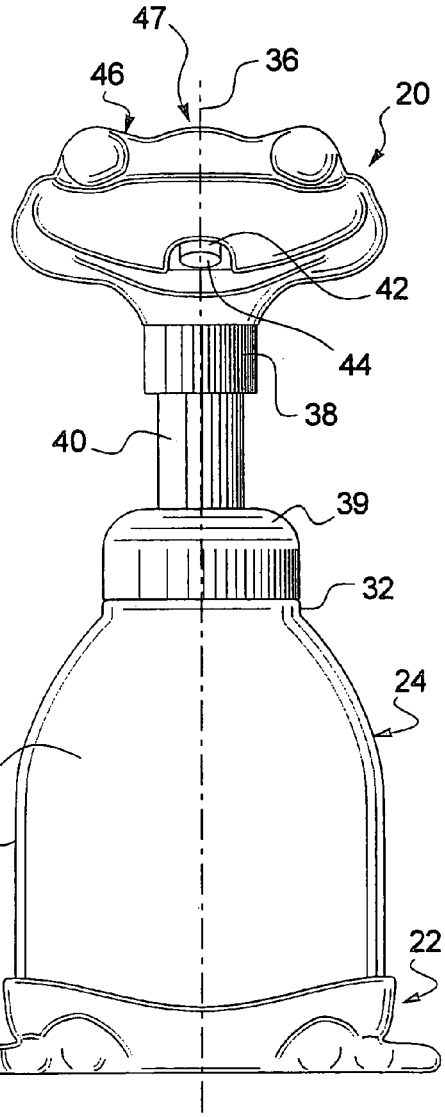
FIG. 2 is a front view of the product dispenser with grip and base accessories of the FIG. 1.

Referring now to FIGS. 1 and 2 of the drawings, accessories for a product dispenser in accordance with the teachings of this disclosure are shown in the form of a grip and a base, generally referred to by the reference numerals 20 and 22, respectively. The grip 20 and base 22 are adapted for attachment, preferably removable attachment, to a product dispenser 24. The product dispenser 24 may contain a liquid, solid, or combination thereof. For example, the product dispenser 24 may hold hand soap, shampoo, baby powder, toothpaste, or other products. Furthermore, the product may be a liquid, solid, or combination thereof. While the drawings illustrate two accessories attached to the product dispenser 24, it will be appreciated that a single accessory or more than two accessories may be provided without departing from the scope of this disclosure.

Figure 3:
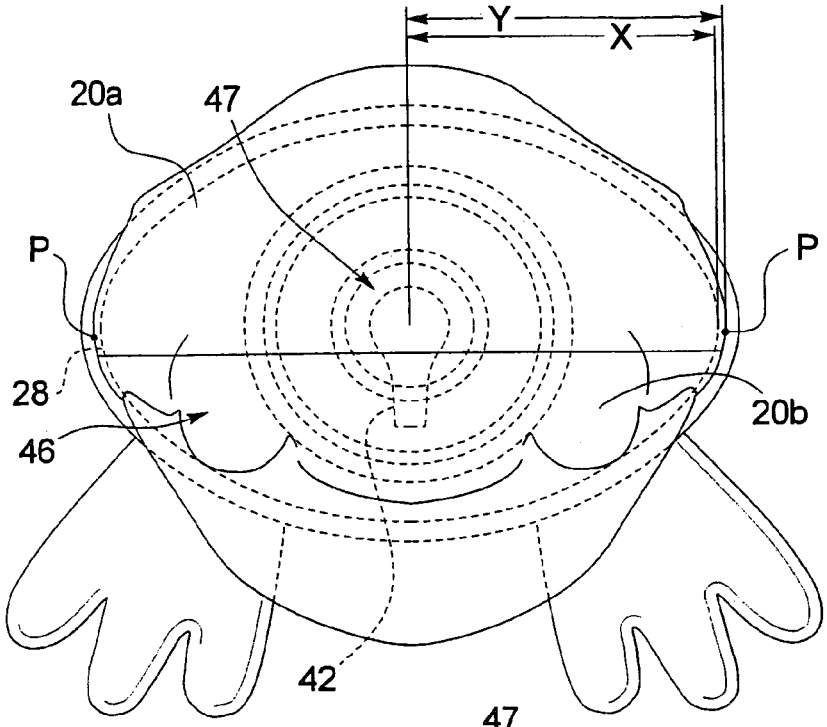
FIG. 3 is a top view of the product dispenser with grip and base accessories of FIG. 1.
Figure 4:
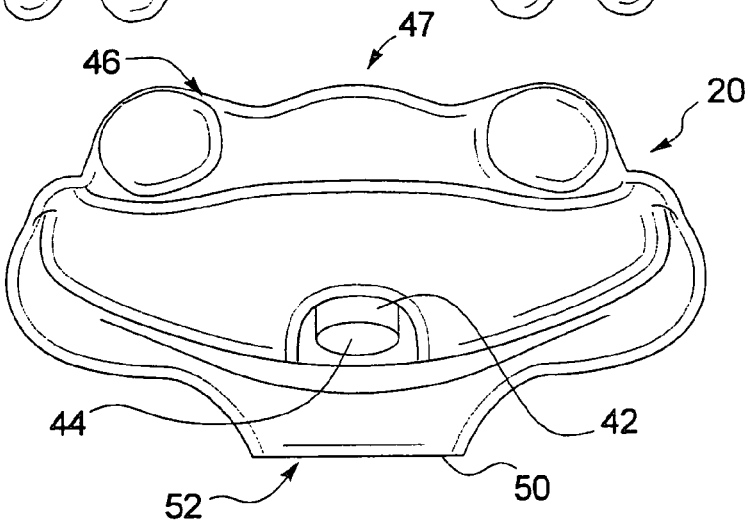
FIG. 4 is a front view of the grip accessory.

The product dispenser 24 includes a container 26 for holding the product. As best shown in FIGS. 1-3, the container 26 includes a bottom wall 28 and a side wall 30 extending upwardly therefrom. The illustrated side wall 30 has an upper portion that is tapered to form a neck 32. A shoulder 34 extends inwardly from the neck 32. The container 26 defines a center axis 36 which, in the illustrated embodiment, extends vertically and may intersect a center of gravity of the container 26 regardless of the extent to which the container is filled with the product. It is not necessary, however, for the center axis 36 to extend vertically, nor is it required that the center axis 36 intersect the center of gravity of the container.

The product dispenser 24 also includes a dispensing mechanism, such as a pump 38, coupled to the container 26 and operable to dispense product from the container. The pump 38 may be coupled to the container 26 using any known type of fastener, such as a threaded engagement between the container neck 32 and a collar 39 provided with the pump. The pump 38 may be of a conventional design commonly used in products such as hand lotions and liquid soaps, wherein the pump includes an internal tube (not shown) extending downwardly into the container 26 and a pump shaft 40 defining an actuating axis along which the shaft may be reciprocated to generate a pressure which draws product up the tube. A head 42 (FIGS. 2 & 3) may be attached to the pump shaft 40 and may define a discharge opening 44, such that the product drawn through the tube continues through the pump shaft 40 and pump head 42 to exit at the discharge opening 44. The pump head 42 may also define an upper surface 46 against which a dispensing force may be applied to actuate the pump head 42 and attached shaft 40, thereby to discharge the product from the container 26.

To operate the pump 38, the dispensing force is applied with sufficient magnitude in the proper direction to actuate the head 42 and shaft 40. In the illustrated embodiment, the direction in which the dispensing force is to be applied is defined by the pump shaft 40, which reciprocates along the actuating axis defined by the shaft. As shown in FIG. 2, the pump shaft 40 is axially aligned with the container center axis 36, and therefore the dispensing force direction is also coincident with the center axis 36 in the illustrated embodiment. It is not necessary, however, for the pump shaft 40 to be aligned with the container center axis 36 and the dispensing force direction need not be coincident with the container center axis 36. Furthermore, while a particular pump 38 has been illustrated and described herein, other types of pumps, as well as other dispensing mechanisms requiring application of a dispensing force, may be provided without departing from the scope of this disclosure. Suitable pumps are available Airspray NV of Alkmaar, The Netherlands.

The assembled container 26 and pump 38 form the product dispenser 24, which has a normal dispensing position in which the product is delivered to a desired target area. In the illustrated embodiment, the product dispenser 24 is intended to be used in an upright position, in which the container 26 rests flush on the container bottom wall 28. When in the normal dispensing position, actuation of the pump shaft 40 will cause product to be dispensed toward the target area. The target area may be located in a direction generally downwardly from the discharge opening 44 and away from the container side wall 30, such as the area where a user would place his or her hands adjacent a liquid soap dispenser during use. The target area may, however, be located in other areas with respect to the product dispenser 24.

At least one accessory is attached to the product dispenser 24 as a stabilizing element adapted to hold the container in the normal dispensing position, thereby to more reliably direct product toward the target area during use. Operation of the pump shaft 40 as described herein requires the dispensing force to be applied in a generally vertically downward direction, substantially coincident with the center axis 36. It is difficult, and particularly so for a child, however, to apply the necessary dispensing force in precisely the correct direction, and therefore, the actual force is typically applied to the pump head 42 at an angle with respect to the pump shaft axis. As a result, the dispensing force may be defined as having an actuating component aligned axially with the pump shaft 40 axis and a tipping component directed perpendicular to the pump shaft axis. The actuating component of the force is directed such that it effects actuation of the pump shaft 40, while the tipping component is directed perpendicular thereto. It has been found that the actuating component must be less than approximately 50 N in order that a child can reliably operate the pump shaft 40. For the illustrated product dispenser 24 in which the container 26 has a normal dispensing position that is upright, the tipping component of the dispensing force may cause the container 26 to slide along the surface on which it is supported or to rotate off of its bottom wall 28 and fall over. As noted above, the rudimentary motor skills of a child make it more likely that the tipping component of the dispensing force will be large enough to slide or tip the container, or otherwise redirect the discharge opening 44 away from the desired target area.

Figure 5:
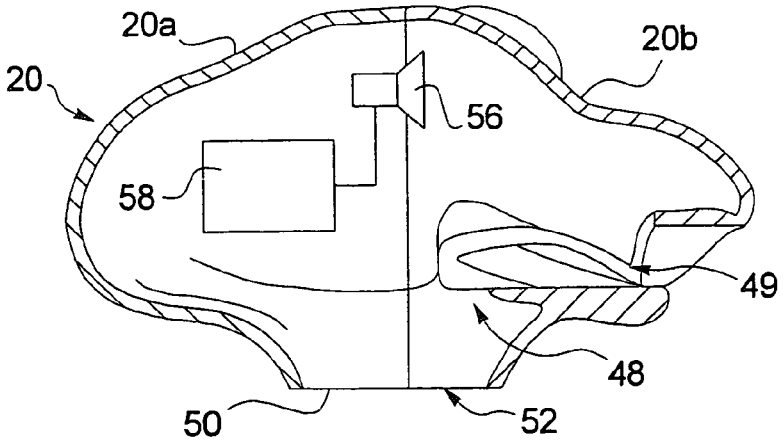
FIG. 5 is a cross-sectional view of the grip accessory taken along line 5-5 of FIG. 4.

To counteract the tipping component of the dispensing force, the grip 20 may provide a stabilizing element that helps maintain the container in the normal dispensing position. The grip 20 may be removably attached to the dispensing mechanism, such as by engaging the pump head 42. For example, the grip 20 may define an internal cavity 48 sized to receive the pump head 42 and may include a lower neck portion 50 defining an orifice 52 sized to prevent easy withdrawal of the grip 20 over the pump head 42, as best shown in FIG. 5. The internal cavity 48 may be sized to accommodate the entire pump head 42 and includes an outlet section 49 that fluidly communicates between the pump head discharge opening 44 and atmosphere, so that product exiting the pump head 42 may pass through the outlet section 49 of the grip 20 and discharge out the opening 44. The outlet section 49 is preferably oriented in a similar direction as the discharge opening 44 so as not to obstruct the flow of product during operation. Alternatively, the outlet section 49 may be oriented such that is redirects product exiting the discharge opening 44 toward any desired target area.

The grip upper surface 46 is adapted to be engaged by a child's hand to actuate the pump 38. The upper surface 46 defines a grasp surface having a surface area that is larger than the surface 46 of the pump head 42. The enlarged grasp surface makes it easier for a child to grip and manipulate the pump 38.

It has been found that the upper surface 46 may be advantageously sized such that at least a portion of an outer periphery of the upper surface 46 extends farther away from the center axis 36 than a corresponding portion of an outer periphery of the container 26. As best shown with reference to FIG. 3, the portion of the grip upper surface 46 nearest the top of the drawing sheet is positioned farther away from the center axis 36 than a corresponding portion of the outer periphery of the container bottom wall 28. Advantageous results have been found with having at least approximately 50% of the upper surface outer periphery extends farther away from the center axis 36 than a corresponding portion of the container bottom wall outer periphery. In the illustrated embodiment, 100% of the upper surface outer periphery extends farther away from the center axis 36 than a corresponding portion of the container bottom wall outer periphery.

To effectively transfer the dispensing force applied to the upper surface 46 of the grip 20 to the pump head 42, the grip 20 must be attached thereto with sufficient rigidity to insure that an effective amount of the dispensing force is transferred so as to form the actuating component. Contributing to this rigid attachment includes forming the grip 20 from a material having sufficient rigidity to transfer enough of the dispensing force so it becomes the actuating component of the pump head, even when that force is applied near a perimeter of the upper surface 46. One such material is polypropylene, however, any material having suitable rigidity to transfer the dispensing force may be used. Also, grip 20 must be sufficiently strongly associated with the pump head 42 so as to insure efficient force transfer.

The grip 20 having the enlarged upper surface 46 further reduces the tipping components of dispensing forces applied in certain directions. The resulting effect of the tipping component depends at least in part on the location of the product dispenser center of gravity relative to the point at which the dispensing force is applied and the direction of the dispensing force. In the illustrated embodiment, the pump head 42 is substantially vertically aligned with the dispenser 24 center of gravity. Accordingly, the dispensing force, if applied efficiently, is directed along a line of action that intersects the dispenser center of gravity. If the dispensing force is applied at any angle with respect to a vertical axis, however, the line of action rotates away from the dispenser center of gravity and, consequently, the product dispenser 24 is more likely to tip. In contrast, when the grip 20 is attached to the pump head 42 and the dispensing force is applied in certain locations and directions, the line of action is rotated toward the dispenser center of gravity thereby to reduce the likelihood of tipping. For example, a dispensing force applied near a periphery of the upper surface 46 and in a direction generally downward and toward the center axis 26 is less likely to cause the dispenser to tip over. That is because the expanded upper surface 46 allows the dispensing force to be applied at a contact point spaced from a vertical axis extending through the dispenser center of gravity, and therefore the line of action along which the force is applied may be closer to or intersects with the dispenser center of gravity. It is likely that a child user will apply the dispensing force in the location and direction noted above, and therefore the grip 20 helps maintain the dispenser 24 in the normal position during use.

The grip 20 may further be sized relative to the container 26 to reduce likelihood of tipping. In particular, the container bottom wall 28 defines the surface on which the dispenser 24 rests, and its size and shape determine how stable the dispenser 24 will be in the normal operating position. To quantify the stability of the dispenser 24, applicants have developed a stability ratio that measures the relative sizes of certain dimensions of the grip 20 and container 26. With respect to the container 26, applicants have identified a maximum container dimension "X" which is the distance from the actuating axis to the farthest point on the periphery of the container bottom wall 28. For the grip 20, a maximum grip dimension "Y" indicates the distance from the actuating axis to the farthest point on the periphery of the grip 20.

The maximum container dimension "X" and the maximum grip dimension "Y" are illustrated in FIG. 3 of the exemplary embodiment. As noted above, the actuating axis is coincident with the container center axis 36. The illustrated container bottom wall 28 has a generally elliptical shape, and therefore can be considered to have a major axis running substantially horizontally across the page as shown in FIG. 3. The maximum container dimension "X" for the container 26, therefore, is the distance from the center axis 36 to the point of intersection between the major axis and the periphery of the bottom wall 28. With respect to the maximum grip dimension "Y", the farthest points on the periphery of the grip 20 occur at side points "P", which coincidentally lie in a plane passing through the major axis and extending perpendicular to the container bottom wall 28. The maximum container and grip dimensions "X" and "Y" are not necessarily located at corresponding parts of the container and grip, respectively, as is the case in the exemplary embodiment, but may instead be located in any relation to one another.

The stability ratio is obtained by dividing the maximum grip dimension "Y" by the maximum container dimension "X". Accordingly, it will be appreciated that a larger stability ratio indicates a relatively larger grip with respect to the container bottom wall 28, while a smaller stability ratio indicates a relatively smaller grip with respect to the container bottom wall 28. A larger stability ratio further indicates that the dispenser is less stable, while a smaller stability ratio indicates that the dispenser is more stable. To sufficiently maintain the dispenser 24 in the normal position during operation by a child, the stability ratio should not exceed 1.4, and is preferably less than approximately 1.1.

The grip may include at least one physical feature attractive to a child. For example, the grip 20 may have a three-dimensional shape that simulates an object, person, anthropomorphic character, or other object. In the illustrated embodiment, the grip 20 is formed as an anthropomorphic character resembling a frog head. Accordingly, the trip 20 may be formed with simulated eyes, a nose, a mouth, and other features associated with a frog. Still further, the grip 20 may have a general color scheme consistent with a frog, such as a green outer surface.

In one particularly desired embodiment, the anthropomorphic character can be associated with icons provided on labeling disposed on container 26. Such icons desirably provide instruction to the child on how to use the product contained within container 26. By associating the anthropomorphic character with the instructional icon the child is encouraged to properly use the product. Further, a caregiver can provide usage instructions in language readily understandable to the child. For example, using the frog embodiment discussed herein, the caregiver could tell the child to do what the frog picture on the frog bottle does.

The enlarged upper surface 46 may be shaped such that it directs a user to apply the force nearer the actuating axis, thereby facilitating successful and tip-free operation by a child. While the upper surface 46 is adapted to receive and transfer dispensing forces applied near its periphery, forces applied in such a location are most prone to tipping the dispenser 24. Accordingly, the upper surface 46 may include a central region 47 that is formed with gradual contours, instead of abrupt surface changes that may discourage a user from applying manual force in those locations. For a grip formed to simulate a physical feature, such as a frog head, the gentle contours of the central region 47 provide a relatively uniform area for receiving the dispensing force that is less likely to result in tipping the dispenser 24, while integrating the region into the overall appearance of the grip 20.

Desirably, the grip 20 is removably attached to the dispensing mechanism (e.g. by engaging the pump head 42). Said another way, the grip 20 may be removed from the pump head 42 associated with a first product dispenser 24 and attached to the pump head of a subsequent product dispenser and therefore allows the grip 20 to be reused. Such removable attachment facilitates transfer of grip 20 from an empty product dispenser 24 to a full one without the additional cost of replacing grip 20.

Preferably, grip 20 is a single element and comprises a material having the requisite balance of stiffness to facilitate transfer of the dispensing force to the pump head 42 while having sufficient stretch to enable a caregiver to transfer grip 20 from an empty dispenser 24 to a full one. The interior design of grip 20 may also be used to facilitate transfer of the dispensing force while maintaining removability. For example, grip 20 may be provided with a collar (not shown) designed to snugly fit around at least a portion of the periphery of pump head 42 so as to effectively couple grip 20 and pump head 42. Further. A plurality of interior ribs (not shown) may be used to couple upper surface 46 to the collar so as to effectively transfer a dispensing force applied thereto to pump head 42.

In an alternative embodiment, grip 20 may also be formed in two pieces 20*a*, 20*b* that separably engage one another so as to facilitate removable attachment to the pump head 42. The grip pieces 20*a*, 20*b* may be attached by snap fit, friction fit, detent tabs, or other fastening engagement. By forming it in separate pieces, the grip 20 is easily assembled onto a pump head 42.

Alternatively, or in addition to, the appearance of the grip 20, the physical feature may interact in more than one way with the child's senses. For example, actuation of dispenser 24 may cause initiation of a signal that, for example, causes the appearance of grip 20 to change (e.g., a change in color or actuation of a light in grip 20) or causes origination of a sound that may be related to the visual feature associated with grip 20. In one alternative embodiment, once initiated, the signal may be maintained for a predetermined time so as to provide reinforcement of a desired behavior. For example, if product dispenser 24 contains a liquid hand soap, the predetermined time may be the time required for the child to thoroughly wash his or her hands. In the sound embodiment discussed herein, that uses the illustrated anthropomorphic frog head as grip 20, a caregiver would be able to instruct the child to manipulate their hands as long as the frog says "ribbit".

This embodiment is further illustrated by consideration of an auditory noise generated during actuation of the product dispenser 24. As best shown in FIG. 5, the grip 20 may include an auditory generator 56 capable of producing sound. The auditory generator 56 may include a sensor 58 adapted to detect a position of the grip 20 and deliver a signal for initiating the noise. For example, the pump head 42 and attached grip 20 may be movable between extended and retracted positions as best shown in FIG. 2. The sensor 58 may be adapted to detect when the grip 20 is in a proximate position, which may generally correspond to the retracted position of the pump head 42, and forward a signal to the auditory generator 56 to deliver sound.

The auditory sound is particularly suited to a child and preferably promotes enthusiasm for using the product dispenser 24. For example, the auditory sound may provide a positive reinforcement upon successfully operating the product dispenser 24, such as verbal or tonal encouragement. Additionally or alternatively, the auditory sound may be a simulated animal sound or cartoon character voice. The auditory sound may correspond to a visual feature provided with the grip 20. In the current embodiment, where the grip 20 is shaped to resemble a simulated frog head, the auditory sound may be a simulated "ribbit" or other noise typically associated with a frog. The auditory sound need not match the visual feature incorporated in the grip 20, but may instead be provided as a simulated human voice, a series of notes, or other composition. Furthermore, the auditory generator may generate more than one type of sound which may be generated sequentially or randomly upon successful actuations of the pump head 42, as desired.

The base 22 may be provided as an additional or alternative stabilizing element for holding the product dispenser 24 in the normal dispensing position. As best shown with reference to FIGS. 6 and 7, the base 22 includes a bottom wall 60 and a side wall 62 extending upwardly therefrom to define a recess 64. The bottom wall 60 includes a bottom surface 66 for engaging the surface upon which the base 22 is placed. The bottom surface 66 is preferably adapted to grip the support surface, such as by friction or suction, thereby to resist sliding movement across the support surface. The side wall 62 is sized so that the container bottom wall 28 and a bottom portion of the container side wall 30 are received in the recess 64. The side wall 62 may be sized so that it frictionally engages the container bottom wall 28 and/or the bottom portion of the container side wall 30. As a result, the base 22 holds the product dispenser 24 in the normal dispensing position, thereby allowing a child to more reliably direct the product toward the intended target area during use.

Figure 6:
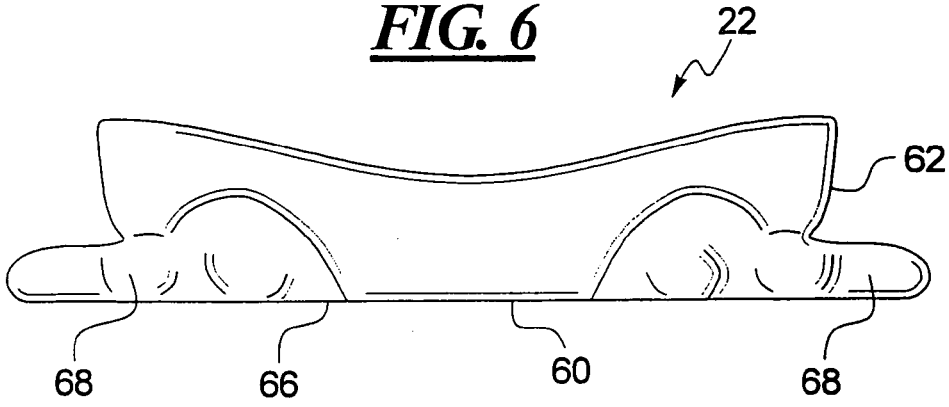
FIG. 6 is a front view of the base accessory.
Figure 7:
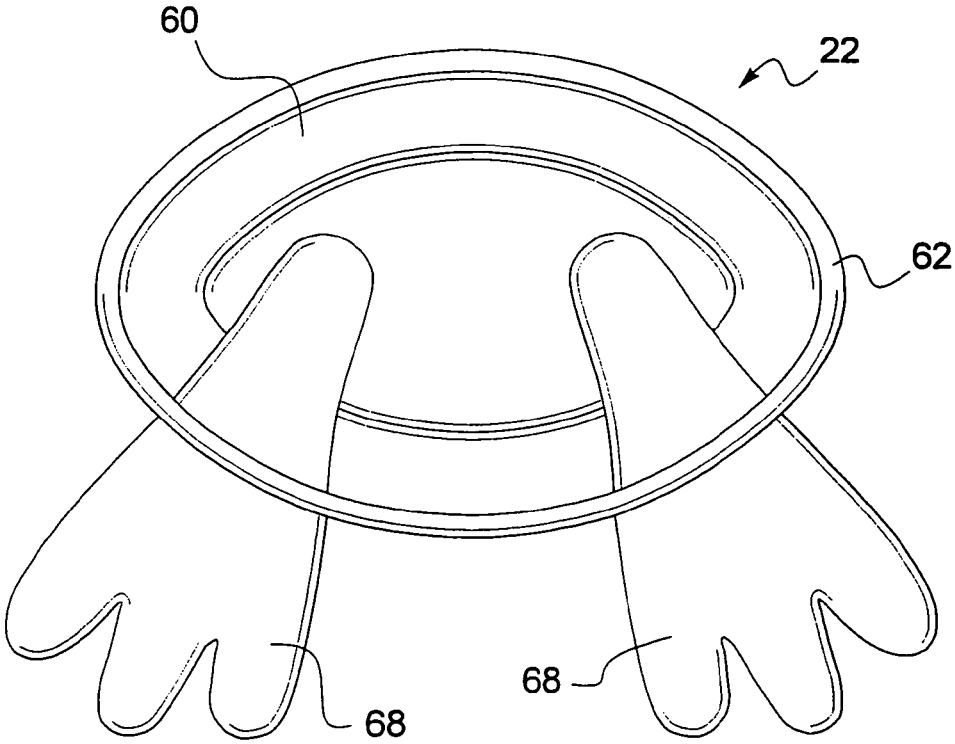
FIG. 7 is a top view of the base accessory.

In addition to stabilizing the location and orientation of the product dispenser 24, the base may also incorporate a physical feature attractive to a child. For example, as shown in FIGS. 6 and 7, the base 22 may be formed with an anthropomorphic feature such as simulated frog feet 68. Where a separate accessory is also provided, such as the grip 20, the physical feature incorporated into the base 22 may correspond to the physical feature incorporated into the other accessory. In the illustrated embodiment, the grip 20 and base 22 consistently incorporate physical features of a simulated frog.

All documents cited in the Detailed Description are, in relevant part, incorporated herein by reference; the citation of any document is not to be construed as an admission that it is prior art with respect to the present disclosure.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this disclosure.

What is claimed is:

1. An accessory for a product dispenser having a container for holding a product, the container defining a center axis and having a bottom wall defining an outer periphery, and a dispensing mechanism coupled to the container and having a dispensing head and a discharge opening, wherein the dispensing head is operable along an actuating axis, the container bottom wall defining a maximum container dimension equal to a distance between the actuating axis and a farthest point on a periphery of the container bottom wall therefrom, the accessory comprising:

a grip removably coupled to the dispensing head and incorporating at least one physical feature attractive to a child, the grip having a grasp surface with a surface area that is larger than a surface area of the dispensing head, the grip being coupled to the dispensing head with sufficient rigidity to transfer an effective amount of an actuating force applied to the grip to the dispensing head, wherein the grip defines a maximum grip dimension equal to a distance between the actuating axis and a farthest point on a periphery of the grasp surface, and a ratio of the maximum grip dimension to the maximum container dimension is less than 1.4.

2. The product dispenser accessory of claim 1, in which the dispensing mechanism is operable along the actuating axis by a dispensing force having an actuating component directed parallel to the actuating axis and a tipping component directed perpendicular to the actuating axis, wherein the grip reduces the tipping component of the dispensing force.

3. The product dispenser accessory of claim 1, in which the grip comprises first and second pieces separably attached to one another.

4. The product dispenser accessory of claim 1, in which the at least one physical feature attractive to a child comprises forming the grip as an anthropomorphic character.

5. The product dispenser accessory of claim 1, in which the grasp surface includes a central region proximate the actuating axis formed with gradual contours.

6. The product dispenser accessory of claim 1, in which the grip comprises an auditory generator.

7. A product dispenser assembly comprising:

a container for holding a product, the container defining a center axis and a normal dispensing position, the container having a bottom wall defining an outer periphery and a dispensing mechanism coupled to the container and having a discharge head operable along an actuating axis and a discharge opening, wherein the container bottom wall defines a maximum;

a dispensing mechanism coupled to the container and having a discharge head operable along an actuating axis and discharge opening adapted to direct product toward a desired target area when the container is in the normal dispensing position, wherein the container bottom wall defines a maximum container dimension equal to a distance between the actuating axis and a farthest point on a periphery of the container bottom wall therefrom; and a grip removably coupled to the dispensing head and incorporating at least one physical feature attractive to a child, the grip having a grasp surface with a surface area that is larger than a surface area of the dispensing head, the grip having sufficient rigidity to transfer substantially all of an actuating force applied to the grip to the dispensing head, wherein the grip defines a maximum grip dimension equal to a distance between the actuating axis and a farthest point on a periphery of the grasp surface, and a ratio of the maximum grip dimension to the maximum container dimension is less than 1.4.

8. The product dispenser assembly of claim 7, in which at least approximately 50% of the grasp surface periphery is located farther away from the center axis than a corresponding portion of the container outer periphery.

9. The product dispenser assembly of claim 8, in which 100% of the grasp surface periphery is located farther away from the center axis than a corresponding portion of the container bottom wall periphery.

10. The product dispenser assembly of claim 7, in which the dispensing mechanism is operable along the actuating axis by a dispensing force having an actuating component directed parallel to the actuating axis and a tipping component directed perpendicular to the actuating axis, wherein the grip reduces the tipping component of the dispensing force.

11. The product dispenser assembly of claim 7, in which the grip comprises a unitary structure adapted to couple to the dispensing head.

12. The product dispenser assembly of claim 7, in which the at least one physical feature attractive to a child comprises forming the grip as a first anthropomorphic character.

13. The product dispenser assembly of claim 12, further comprising a base adapted to frictionally to engage a bottom portion of the container, wherein the base includes a bottom wall adapted to grip a support surface on which the base is placed.

14. The product dispenser assembly of claim 13, in which the base provides a second physical feature attractive to a child by forming the base with a second anthropomorphic feature that relates to the first anthropomorphic character.

15. The product dispenser assembly of claim 7, in which the grasp surface includes a central region proximate the actuating axis formed with gradual contours.

16. The product dispenser assembly of claim 7, in which the ratio of the maximum grip dimension to the maximum container dimension is less than approximately 1.1.

17. The product dispenser assembly of claim 7, in which the grip comprises and auditory generator.

18. An accessory for a product dispenser having a container for holding a product, the container defining a center axis and having a bottom wall defining an outer periphery, and a dispensing mechanism coupled to the container and having a dispensing head and a discharge opening, wherein the dispensing head is operable along an actuating axis by a dispensing force having an actuating component directed parallel to the actuating axis and a tipping component directed perpendicular to the actuating axis, the container bottom wall defining a maximum container dimension equal to a distance between the actuating axis and a farthest point on a periphery of the container bottom wall therefrom, the accessory comprising:

a grip removably coupled to the dispensing head and incorporating at least one physical feature attractive to a child, the grip having a grasp surface with a surface area that is larger than a surface area of the dispensing head, the grip being coupled to the dispensing head with sufficient rigidity to transfer an effective amount of an actuating force applied to the grip to the dispensing head, wherein the grip defines a maximum grip dimension equal to a distance between the actuating axis and a farthest point on a periphery of the grasp surface, and a ratio of the maximum grip dimension to the maximum container dimension is less than 1.4, thereby to reduce the tipping component of the dispensing force.

19. The product dispenser accessory of claim 18, in which the grip comprises first and second pieces separably attached to one another.

20. The product dispenser assembly of claim 19, in which the grip comprises a unitary structure adapted to couple to the dispensing head.

21. The product dispenser accessory of claim 18, in which the grasp surface includes a central region proximate the actuating axis formed with gradual contours.

22. The product dispenser accessory of claim 18, in which 100% of the grasp surface periphery is located farther away from the center axis than a corresponding portion of the container bottom wall periphery.

23. The product dispenser accessory of claim 18, in which the grip comprises an auditory generator.

24. An accessory for a product dispenser having a container for holding a product, the container defining a center axis and having a bottom wall defining an outer periphery, and a dispensing mechanism coupled to the container and having a dispensing head and a discharge opening, wherein the dispensing head is operable along an actuating axis, the container bottom wall defining a maximum container dimension equal to a distance between the actuating axis and a farthest point on a periphery of the container bottom wall therefrom, the accessory comprising:

a grip removably coupled to the dispensing head and having a three-dimensional shape that simulates a feature attractive to a child chosen from at least one of an object, a person, and an anthropomorphic character, the grip having a grasp surface with a surface area that is larger than a surface area of the dispensing head, the grip being coupled to the dispensing head with sufficient rigidity to transfer an effective amount of an actuating force applied to the grip to the dispensing head, wherein the grip defines a maximum grip dimension equal to a distance between the actuating axis and a farthest point on a periphery of the grasp surface, and a ratio of the maximum grip dimension to the maximum container dimension is less than 1.4.

25. The accessory according to claim 24 wherein said grip comprises an outlet section such that product exiting said dispensing head passes through said outlet section of said grip.

26. The accessory according to claim 24 wherein said grip comprises an outlet section that is oriented in a similar direction as the discharge opening of said dispensing mechanism.

27. The accessory according to claim 24 wherein said grip comprises an outlet section that is oriented such that said outlet section redirects product exiting said discharge opening toward a target area.

* * * * *